US007556073B2

(12) United States Patent
Lyons

(10) Patent No.: US 7,556,073 B2
(45) Date of Patent: Jul. 7, 2009

(54) FRONT POCKET WALLET

(76) Inventor: Michael L. Lyons, 88 Pleasant Valley Rd., Cumberland Center, ME (US) 04021

( * ) Notice: Subject to any disclaimer, the term of this patent is extended or adjusted under 35 U.S.C. 154(b) by 776 days.

(21) Appl. No.: 10/724,653

(22) Filed: Dec. 1, 2003

(65) Prior Publication Data

US 2004/0108032 A1 Jun. 10, 2004

Related U.S. Application Data

(60) Provisional application No. 60/430,209, filed on Dec. 2, 2002.

(51) Int. Cl.
*A45C 1/06* (2006.01)

(52) U.S. Cl. ..... 150/132; 150/140; 150/145; 150/147; 150/131; 150/150

(58) Field of Classification Search ..... 150/137, 150/141, 131–134, 136, 139, 140, 154, 147, 150/150; D3/249, 253, 250, 247; 224/267
See application file for complete search history.

(56) References Cited

U.S. PATENT DOCUMENTS 601,922 A * 4/1898 Wieland ..... 150/132
1,972,480 A * 9/1934 Gomi ..... 224/222
2,435,032 A * 1/1948 Campbell ..... 150/133
4,209,048 A * 6/1980 Sandos ..... 150/132
4,332,338 A * 6/1982 Christiansen ..... 224/222
4,570,688 A * 2/1986 Williams ..... 150/134
4,763,821 A * 8/1988 Powell ..... 224/267
4,905,881 A * 3/1990 Graber ..... 224/222
5,024,258 A 6/1991 Morehead ..... 150/140
5,341,972 A * 8/1994 Jacks ..... 224/165
5,671,481 A * 9/1997 Giard ..... 2/170
6,223,958 B1 * 5/2001 Kohn ..... 224/219

OTHER PUBLICATIONS

Physical sample: Applicant's invention (same as Exhibit I to Amendment A mailed Feb. 16, 2006).
Photographic print (annotated): Applicant's invention (photograph of Exhibit I to Amendment A mailed Feb. 16, 2006).
Physical sample: front trousers pocket (same as Exhibit III to Amendment A mailed Feb. 16, 2006).
Rogue Wallet Company, Point-of-Sales placard, Feb. 16, 2006 (same as Exhibit II to Amendment A mailed Feb. 16, 2006).
eBay, Inc., Website (as in Exhibit V to Amendment A mailed Feb. 16, 2006) <cgi.ebay.com/ws/eBayISAPl.dll?ViewItem &item=8250057682&rd=1&sspag>.

* cited by examiner

*Primary Examiner*—Tri M Mai
(74) *Attorney, Agent, or Firm*—Pierce Atwood LLP; Kevin M. Farrell; Katherine A. Wrobel

(57) ABSTRACT

A folding wallet configured to fit the front pockets of trousers, thereby encouraging such use to avoid neurological injury caused by carrying a wallet in the rear pockets of trousers.

9 Claims, 3 Drawing Sheets

Figure 1
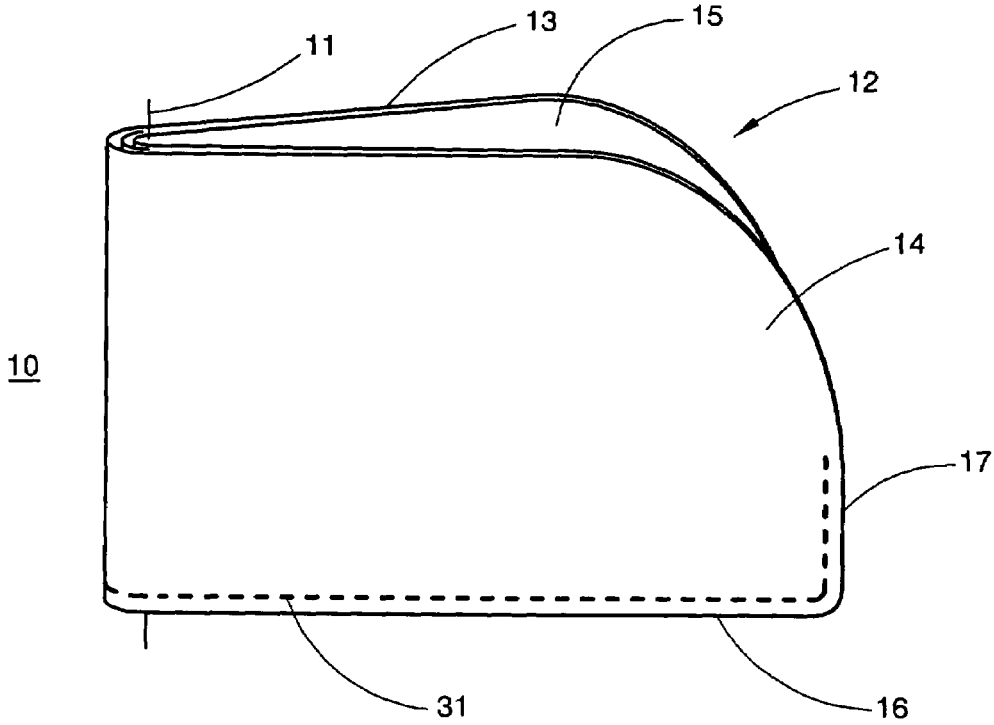
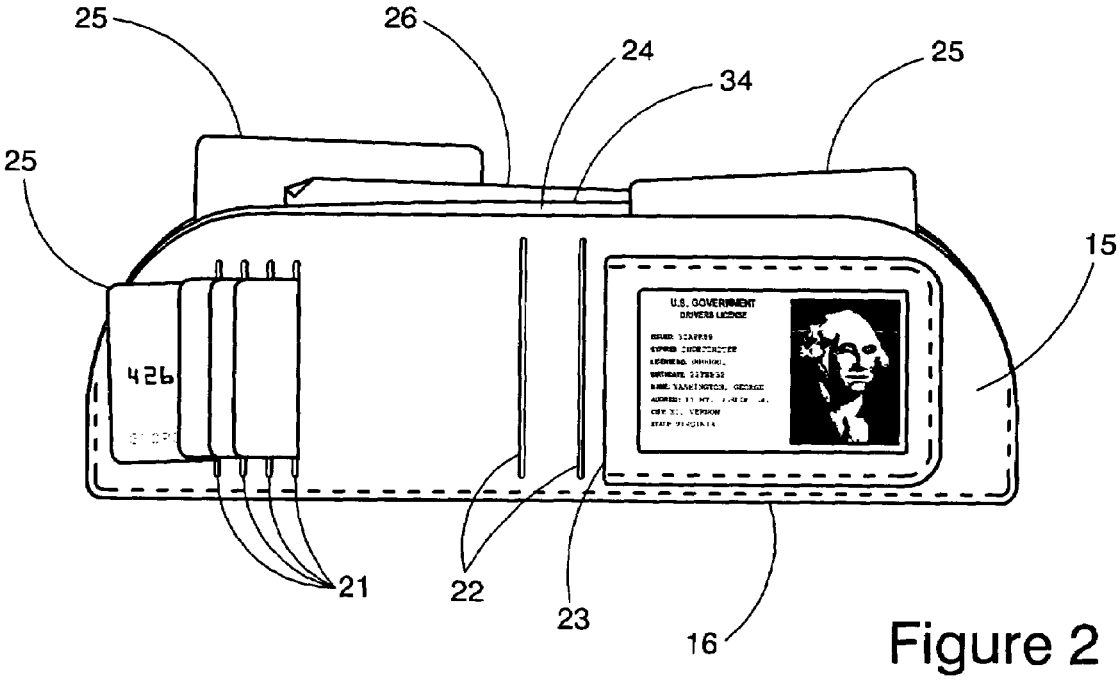
Figure 2

Figure 4
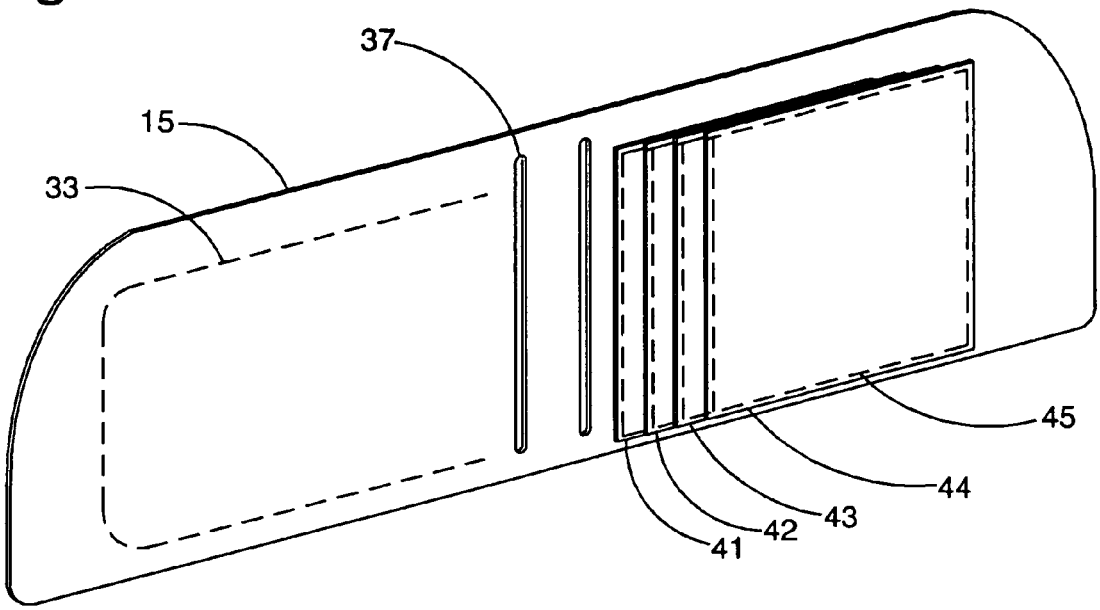
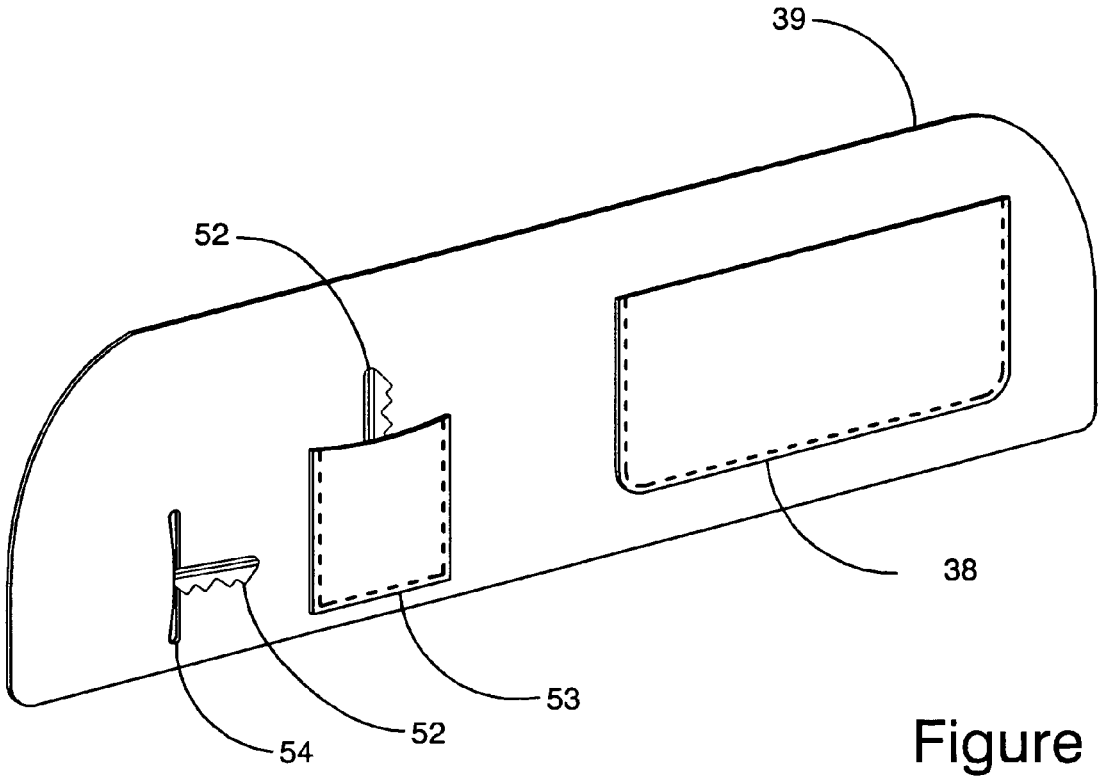
Figure 5

FRONT POCKET WALLET

CROSS-REFERENCE TO RELATED APPLICATIONS

Provisional Patent Application No. 60/430,209 filed Dec. 2, 2002

STATEMENT REGARDING FEDERALLY SPONSORED RESEARCH OR DEVELOPMENT

Not applicable

BACKGROUND OF THE INVENTION

Customary wallets are generally rectangular in shape, matching both the shape of folding money and the shape of a typical rear trouser pocket. It is known that carrying such a wallet in a rear pocket, especially while seated for prolonged periods, can be a cause of back pain, sciatica and spinal misalignment, and it is thus recommended that one carry the wallet not in the rear pocket.

BRIEF SUMMARY OF THE INVENTION

Front pockets are often shaped differently from rear pockets, being tapered toward their closed end. The invention here is a wallet which, when folded, has a tapered end to better fit such a front pocket.

BRIEF DESCRIPTION OF THE SEVERAL VIEWS OF THE DRAWINGS

FIG. 1 shows a general view of the invention, in its closed configuration.

FIG. 2 shows the invention in its open configuration.

FIG. 4 shows detail features of the invention.

FIG. 5 shows details of a key pocket.

Figure 3:
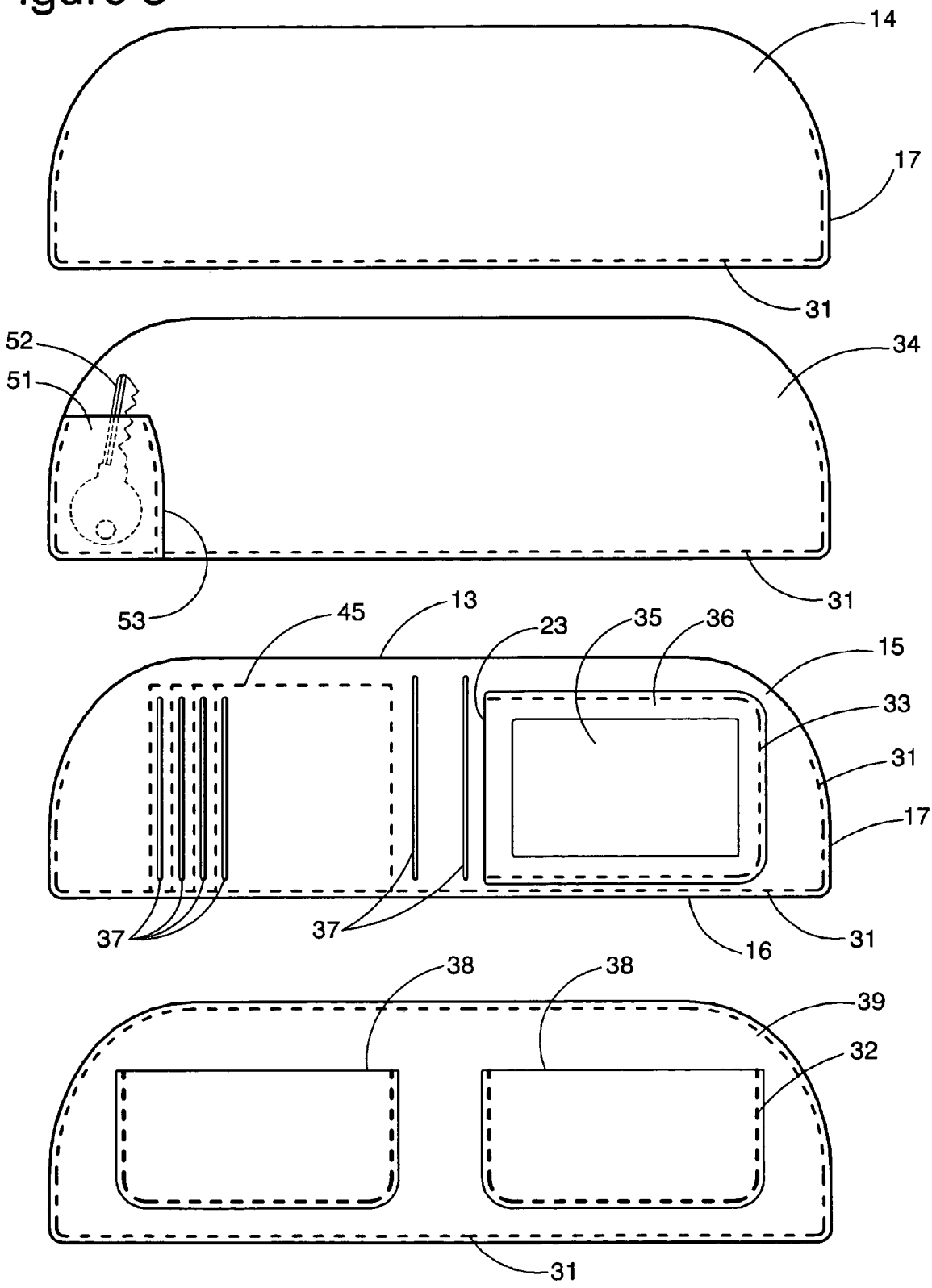
FIG. 3 shows the means of stitching or otherwise sealing the edges of the invention.

| REFERENCE NUMERALS USED IN DRAWINGS | |
|---|---|
| 10 | wallet |
| 11 | fold line |
| 12 | rounded tapering |
| 13 | shorter edge |
| 14 | outer panel |
| 15 | inner panel |
| 16 | longest edge |
| 17 | end |
| 21 | overlapping pockets |
| 22 | hidden pockets |
| 23 | window pocket |
| 24 | money pocket |
| 25 | financial cards |
| 26 | folding money |
| 31 | stitching line |
| 32 | stitching line |
| 33 | stitching line |
| 34 | separator panel |
| 35 | transparent panel |
| 36 | frame |
| 37 | entrance slots |
| 38 | card pocket |
| 39 | internal panel |
| 41 | fabric layer |
| 42 | fabric layer |
| 43 | fabric layer |
| 44 | fabric layer |

-continued

| REFERENCE NUMERALS USED IN DRAWINGS | |
|---|---|
| 45 | stitching lines |
| 51 | key pocket |
| 52 | key |
| 53 | panel |
| 54 | slot |

DETAILED DESCRIPTION OF THE INVENTION

Referring to FIG. 1, what is seen is the appearance of the wallet 10 in its normal, closed configuration folded at fold line 11. Obvious is the unilateral, rounded tapering 12 of the wallet's shorter edge 13, such that it approximates the shape of a typical trousers front pocket. Characteristic dimensions might be, for example, a width of 8-10 cm, an overall folded length of 12-15 cm, and a thickness of 1-3 cm, this thickness being dependent upon materials stored within the wallet. Shown also are exposed surfaces of outer panel 14 and inner panel 15, longest edge 16 and ends 17.

FIG. 2 shows the wallet 10 unfolded in its open configuration, revealing a plurality of pockets 21, 22, 23, 24 from which items stored in the wallet may be easily removed and replaced. Shown also are financial cards 25, folding money 26 and a transparent window pocket 23 through which may be seen a photographic identification card, driver's license or the like.

FIG. 3 shows components of the empty wallet 10 in its preferred embodiment, and further reveals stitching lines 31, 32 and 33 along which adjacent panels of material are bonded together, as by adhesive, stitched thread, thermal sealing or other means as appropriate to the chosen materials of construction. Shown separately for clarity are outer panel 14, separator panel 34, inner panel 15 and internal panel 39 which, when bonded in a preferred sequence and folded form the wallet 10 itself.

The invention, in its preferred embodiment, is constructed primarily from natural or artificial leather, and sewn together using heavy-duty sewing thread. Individual panels are typically die cut to size and to include any slits, slots or other openings as may be needed in these panels. Similarly, panels of transparent or opaque plastic or other fabric may be cut to shape for adding to the construction.

Stitching or other means of fastening is used for fastening together pairs or multiple layers of panels. In a simple form of the preferred embodiment, a leather outer panel 14, an intermediate cloth fabric separator panel 34 and a leather inner panel 15 are matched superjacently and sewn together entirely along their longest edge 16, and thence sewn upward along their edges at each end 17 for a distance of 2-3 cm. This forms two money pockets 24, one between the outer panel 14 and the separator panel 34, and the other between the separator panel 34 and the inner panel 15, each of which may be used separately to contain folding money 26 and for other flexible thin materials such as receipts, notes or the like.

Transparent window pocket 23 is preassembled to the exposed surface of the inner panel 15, and is preferably constructed of a colorless, transparent panel 35 of flexible polymeric sheet material such as vinyl, polycarbonate or the like stitched inside a surrounding frame 36 of leather material which in turn is stitched along three of its edges to the exposed surface of the inner panel 15. The edge of frame 36 left unstitched is parallel and adjacent to the fold line 11 of the wallet 10, such that a photographic identification card may be inserted under transparent panel 35 when the wallet 10 is fully open, yet is protected from loss when the wallet 10 is folded closed. Under the transparent panel 35, the photograph is readily visible without removing the card from the transparent window pocket 23.

In the preferred embodiment there is also a series of overlapping pockets 21 preassembled on the hidden surface of the inner leather panel 15, facing the transparent window pocket 23 when wallet 10 is folded closed, for containing and protecting multiple additional financial cards 25 or the like. The entrance slots 37 to these pockets 21 are shown positioned such that the financial cards 25 are inserted and removed horizontally, although overlapping pockets 21 may alternatively be constructed rotated 90 degrees clockwise for conventional vertical loading.

Further in a more desired form of the preferred embodiment, four additional card pockets 38 are preassembled, two on each of two leather internal panels 39, for containing flat, rigid objects such as financial cards 25, calculators or the like. These additional card pockets 38 are sewn to the inner, exposed surfaces of internal panels 39 along three of each such pocket's four edges, leaving open the pocket's edge adjacent to the wallet's shorter edge 13 for insertion or removal of such objects. The hidden surfaces of internal panels 39 are then stitched around their entire perimeter to the hidden surfaces of outer panel 14 and of inner panel 15 along stitching line 31.

Additionally, in the preferred embodiment, there is a hidden pocket 22 under each of the transparent window pocket 23 and the set of overlapping pockets 21. The entrance slot 37 to each of these hidden pockets 22 is both parallel and adjacent to the fold line 11 of the wallet 10, such that thin flat items such as photographs, eyeglass prescriptions or business cards may be inserted into these hidden pockets 22 horizontally. A preferred method for inserting would be to preload a multitude of such items in a sleeve or envelope, constructed from a low-friction material such as polymeric plastic film, such that the items are protected from buckling damage during insertion and withdrawal.

FIG. 4 examines several details of these features on the hidden surface of inner panel 15 in the preferred embodiment, such as pockets for storage, windows for viewing, and the like. Shown is the hidden side of stitching line 33 for window pocket 23 and four fabric layers 41, 42, 43 and 44, secured by stitching lines 45 to form overlapping pockets 21. Also shown are entrance slots 37 which serve as the loading points for hidden pockets 22.

And finally, in a preferred embodiment there is provided a key pocket 51, preferably accessible within the folding money pocket 24, for hidden storage of a key 52. Such a key pocket 51 may be formed by a separate panel 53 stitched to an exposed surface of internal panels 39 or to either surface of separator panel 34, or it alternatively may be provided as a simple slot 54 in one or more of internal panels 39.

Though the above description is of necessity specific, the scope of the invention should be determined by the appended claims rather than by any specific embodiments recited here.

I claim:

1. A folding pocket wallet that, when unfolded into its open configuration, is substantially shaped as an isosceles trapezoid whose two diagonal legs are each convexly rounded, said unfolded folding pocket wallet thereby comprising (a) a longest edge corresponding to the lower base of said trapezoid;

(b) a shorter edge corresponding to the upper base of said trapezoid, said shorter edge defining the edge of a money pocket within said folding pocket wallet through which edge may be passed folding money;

(c) two opposing ends;

(d) two convexly rounded edges corresponding generally to the diagonal legs of said trapezoid and extending from said shorter edge to said two opposing ends;

(e) a fold line extending from the midpoint of said longest edge to the midpoint of said shorter edge; whereby folding closed about said fold line creates a substantially flat folding pocket wallet shaped to fit a front trousers pocket, and whereby use of said substantially flat folding pocket wallet obviates spinal misalignment and neural damage;

(f) a separate outer panel;

(g) a separate inner panel; and (h) a separate separator panel disposed therebetween;

each of said panels substantially identical in shape and outline, aligned to and stitched or otherwise fastened along said longest edge and along at least a portion of each of said opposing ends.

2. The folding pocket wallet of claim 1 wherein each of said outer panel and said inner panel further comprises an exposed surface and a hidden surface, said folding pocket wallet further comprising at least one internal panel substantially identical in shape and outline to said outer panel and said inner panel and likewise comprising an exposed surface and a hidden surface, each said internal panel hidden surface disposed against said inner panel hidden surface, said outer panel hidden surface, or both, and stitched or otherwise fastened thereto along the entire perimeter thereof.

3. The folding wallet of claim 2 wherein said internal panel further comprises at least one card pocket fastened to said exposed surface thereof.

4. The folding wallet of claim 2 wherein said internal panel further comprises at least one key pocket fastened to said exposed surface thereof.

5. The folding wallet of claim 2 wherein said internal panel further comprises at least one through slot creating thereby a key pocket between said internal panel and said inner panel or outer panel to which said internal panel is fastened.

6. The folding wallet of claim 2 wherein said separator panel comprises at least one key pocket fastened thereto.

7. The folding wallet of claim 2 wherein said inner panel further comprises a transparent window pocket fastened on the exposed surface thereof.

8. The folding wallet of claim 2 wherein said inner panel further comprises a series of parallel through slots and a corresponding series of fabric layers forming thereby a series of overlapping pockets on said hidden surface thereof.

9. The folding wallet of claim 2 wherein said inner panel further comprises at least one through slot forming thereby a hidden pocket between said inner panel and said internal panel.

* * * * *